US008720096B2

(12) United States Patent
Siddle

(10) Patent No.: US 8,720,096 B2
(45) Date of Patent: May 13, 2014

(54) HAMMERLESS, STRIKER FIRED MODEL 1911 HANDGUN AND ASSOCIATED METHODS

(75) Inventor: Kevin Siddle, Millstadt, IL (US)

(73) Assignee: Double Nickel Holdings, LLC, Milstadt, IL (US)

( * ) Notice: Subject to any disclaimer, the term of this patent is extended or adjusted under 35 U.S.C. 154(b) by 117 days.

(21) Appl. No.: 13/559,879

(22) Filed: Jul. 27, 2012

(65) Prior Publication Data

US 2013/0180394 A1 Jul. 18, 2013

Related U.S. Application Data

(60) Provisional application No. 61/587,496, filed on Jan. 17, 2012.

(51) Int. Cl.
*F41A 19/12* (2006.01)

(52) U.S. Cl.
CPC ..... *F41A 19/12* (2013.01)
USPC ..... 42/69.01; 42/69.02

(58) Field of Classification Search
CPC ..... F41A 19/06; F41A 19/10; F41A 19/12; F41A 19/13; F41A 19/25; F41A 19/26; F41A 19/27; F41A 19/28; F41A 19/30; F41A 19/31; F41A 19/32; F41A 19/29
USPC ..... 42/69.01, 69.02, 70.05
See application file for complete search history.

(56) References Cited

U.S. PATENT DOCUMENTS

| | | | | |
|---|---|---|---|---|
| 4,275,640 | A | 6/1981 | Wilhelm | |
| 4,555,861 | A * | 12/1985 | Khoury | 42/69.01 |
| 4,825,744 | A | 5/1989 | Glock | |
| 5,050,480 | A | 9/1991 | Knight, Jr. et al. | |
| 5,157,209 | A | 10/1992 | Dunn | |
| 5,166,458 | A | 11/1992 | Yoo | |
| 5,386,659 | A | 2/1995 | Vaid et al. | |
| 5,701,698 | A | 12/1997 | Wesp et al. | |
| 5,822,903 | A * | 10/1998 | Davis, Sr. | 42/69.01 |
| 5,906,066 | A * | 5/1999 | Felk | 42/69.02 |
| 5,915,934 | A | 6/1999 | Knight et al. | |
| 6,283,006 | B1 | 9/2001 | Szabo et al. | |
| 6,347,474 | B1 | 2/2002 | Wolff, Jr. | |
| 6,560,909 | B2 | 5/2003 | Cominolli | |
| 7,617,628 | B2 | 11/2009 | Curry | |
| 2011/0041680 | A1 * | 2/2011 | Smirnov | 89/125 |
| 2012/0117841 | A1 * | 5/2012 | Joubert et al. | 42/69.01 |

* cited by examiner

*Primary Examiner* — Michael Carone
*Assistant Examiner* — Joshua Freeman
(74) *Attorney, Agent, or Firm* — Thompson Coburn LLP

(57) ABSTRACT

A single action, semi-automatic handgun has a slide, a firing pin assembly disposed in a hollow interior of the slide, and a trigger bow assembly disposed in a frame of the handgun below the slide. The trigger bow assembly comprises a trigger bow configured for reciprocating sliding motion. The trigger bow has a trigger bow lever configured for reciprocating sliding motion in plane generally transverse to the movement of the slide. The hand gun further comprises a sear assembly with a sear having a tab and a sear pin. The sear tab releasably engages the firing pin assembly and the sear pin releasably engages the trigger bow lever in a manner to enable successive discharging of the handgun upon successive actuation of the trigger of the firearm.

34 Claims, 11 Drawing Sheets

HAMMERLESS, STRIKER FIRED MODEL 1911 HANDGUN AND ASSOCIATED METHODS

RELATED APPLICATION DATA

This application claims the benefit of provisional application Ser. No. 61/587,496, filed Jan. 17, 2012, the disclosure of which is incorporated by reference herein.

BACKGROUND

This disclosure relates to a firing system for a model 1911 handgun. The firing system includes a striker-fired mechanism that does not incorporate a pivoting hammer to actuate the firing pin. In the system described below, the handgun may be prepared for firing by racking the slide to draw a round to the chamber. This eliminates the need to lock the hammer before firing as is customarily performed during the ordinary use of a model 1911 handgun. Accordingly, this disclosure includes modifying existing model 1911 handguns to incorporate a hammerless, striker-fired system. Additionally, the disclosure relates to a model 1911 handgun which may be constructed with a hammerless, striker-fired system.

DETAILED DESCRIPTION

Figure 1:
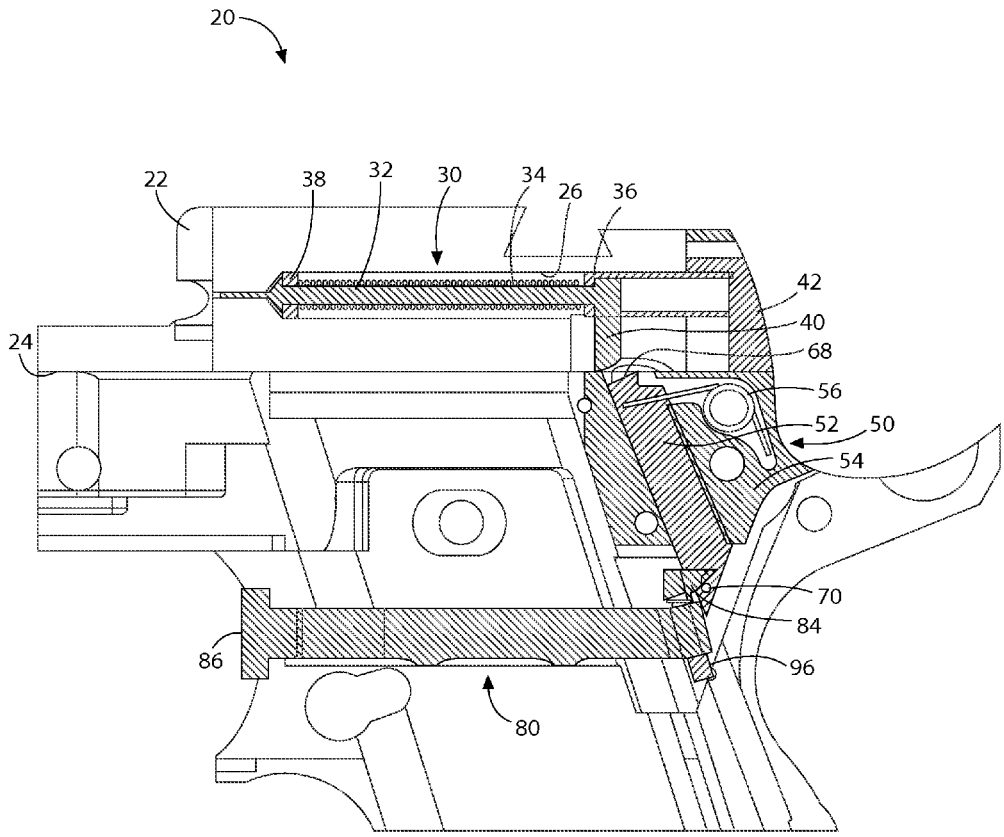
FIG. 1 shows a cross-sectional model view of a model 1911 handgun of the present disclosure in a cocked position with the main parts used to retrofit a model 1911 handgun into a hammerless, striker-fired system (i.e., firing pin assembly, sear assembly and trigger bow assembly) being shown in cross hatching.

The terms up, down, left, right, horizontal, and vertical are used for purposes of ease of illustrating the disclosed embodiments and the relative orientation of the parts as shown in the drawings. The terms are not intended to limit any disclosed embodiment in any way.

Figure 2:
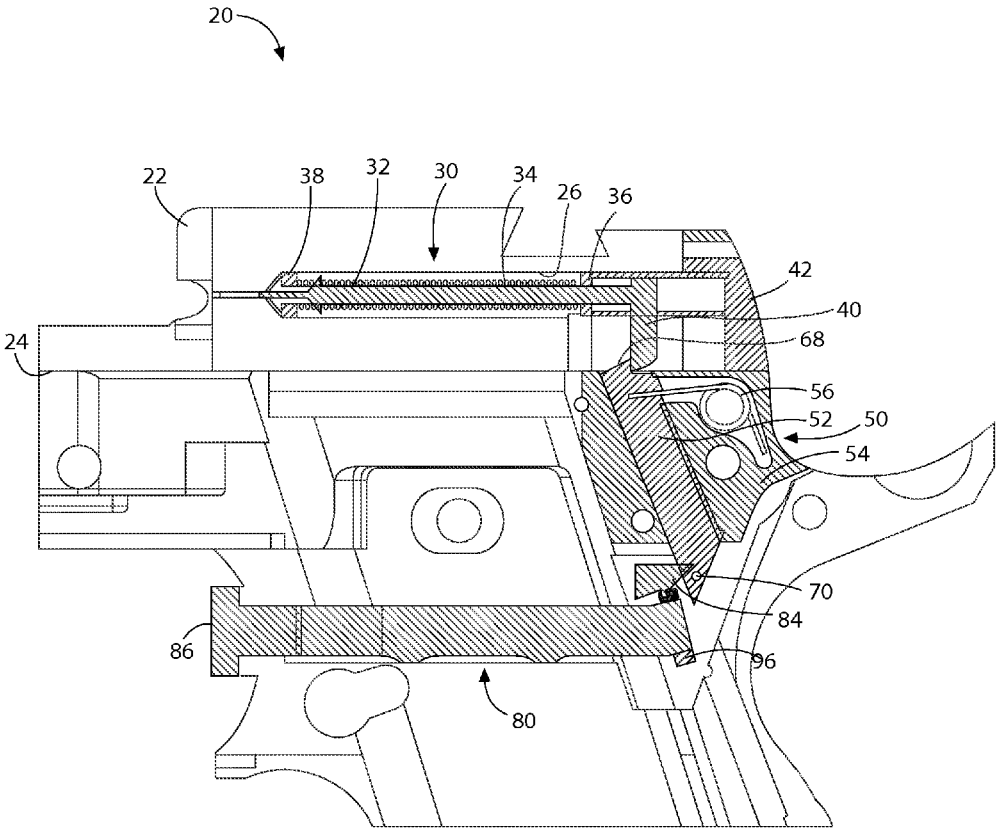
FIG. 2 shows the hand gun of FIG. 1 with the firing pin assembly impacting a cartridge at discharge of the hand gun.

FIG. 1 shows a cross-sectional model view of a model 1911 handgun of the present disclosure in a cocked position with the main parts used to retrofit a model 1911 handgun into a hammerless, striker-fired system (i.e., firing pin assembly, sear assembly and trigger bow assembly) being shown in cross hatching. FIG. 2 shows the hand gun of FIG. 1 with the firing pin assembly impacting a cartridge at discharge of the cartridge. Although a model 1911 hand gun is referenced throughout and shown in the drawings, the principles described herein may be applied in the context of any single-action, semiautomatic weapon system.

Referring to FIGS. 1 and 2, the handgun 20 has a slide 22 and a receiver 24 mounted on the slide with rails for relative horizontal (in FIGS. 1,2) reciprocating motion between the receiver and slide. At the breech end of the slide, a firing pin bore 26 is provided. Inside the firing pin bore 26, a firing pin assembly 30 is provided. The firing pin assembly includes a firing pin 32 and a firing pin spring 34 with the firing pin spring disposed between a sleeve 36, and a washer or spring cup 38. The firing pin 32 has a distal end which impacts the cartridge when the hand gun is discharged. The firing pin has a proximal end with a firing pin lug 40. The firing pin 32 is adapted for reciprocating motion inside the firing pin bore 26. The firing pin sleeve 36 is split to accommodate the reciprocating motion of the firing pin lug 40. The firing pin spring 32 may be preloaded in the firing pin bore between the firing pin sleeve 36 at the proximal end of the firing pin and the firing pin washer or spring cup 38 at the distal end of the firing pin. The firing pin bore 26 may be sized such that the firing pin spring, firing pin sleeve, and firing pin washer preload the firing pin spring in the firing pin bore. A breech closure 42 together may be provided on the breech end of the slide. When the hand gun is ready for fire, the firing pin would be positioned to the right of the sear 50 as shown in FIG. 1. When the hand gun is to discharge or impact a cartridge, the firing pin and sear are positioned as shown in FIG. 2.

The firing pin lug or nose 40 extends downward from the slot of the slotted firing pin sleeve 36 into the hollow interior of the slide to engage the sear assembly 50. The sear assembly includes a sear 52 which is movable upward from the receiver into the hollow interior of the slide to engage the firing pin lug or nose, and downward into the receiver out of the hollow interior of the slide to release the firing pin lug or nose. When the sear 52 engages the firing pin lug 40 (i.e., positioned to the right of the sear as shown in FIG. 1), the firing pin is urged by spring pressure from the cartridge. Accordingly, when the sear 52 disengages or releases from the firing pin lug 40, the firing pin 32 is thrust forward under pressure from the firing pin spring 34 such that the distal end of the firing pin impacts the cartridge to discharge the hand gun. In FIG. 2, the firing pin is shown in the firing position engaging a cartridge. In other words, in FIG. 2, the sear block has released or disengaged from the firing pin lug forcing the firing pin under spring pressure against the cartridge.

Figure 3:
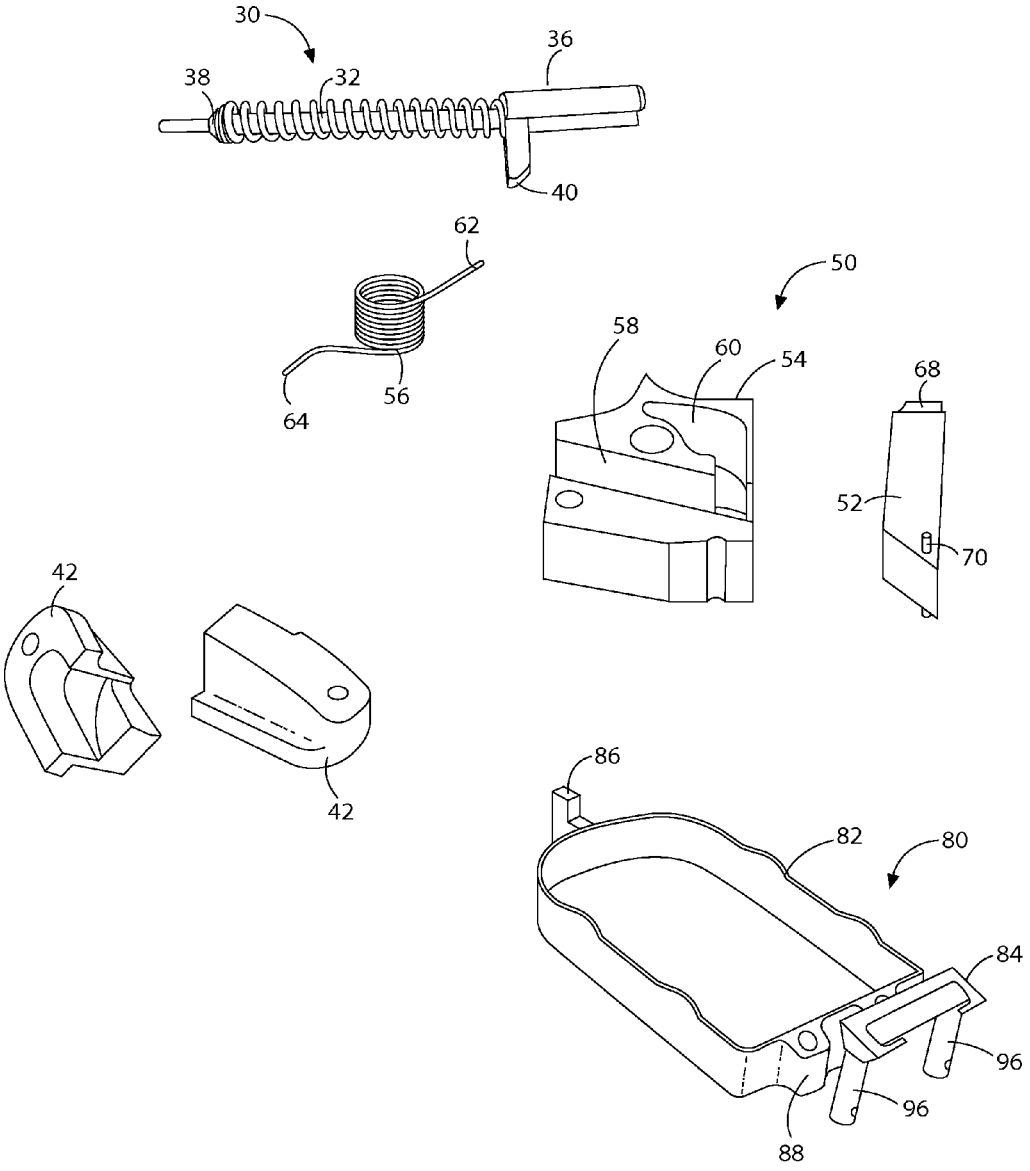
FIG. 3 shows the main parts used to retrofit a model 1911 handgun into a hammerless, striker-fired system.

FIGS. 3 and 9-11 provide further detail of the firing pin assembly including the firing pin 32, the firing pin spring 34, the firing pin sleeve 36, and the firing pin washer or spring cup 38. FIG. 3 also shows the breech closure 42. The breech closure fits on the breech end of the slide in a manner so as to replace the hammer mechanism ordinarily found at the breach end of the model 1911 handgun. The breech closure 42 may be sized to preload the firing pin spring in the firing pin bore between the firing pin spring and the firing pin washer or spring cup. For instance, in a retrofit of an existing model 1911 hand gun slide or the assembly of a striker fired hand gun as disclosed herein, after the firing pin assembly 30 is installed in the firing pin bore 26, the breech closure 42 may be installed at the breech end of the slide to enclose the slide, thereby holding the firing pin assembly in the firing pin bore. FIGS. 1 and 2 show a fastener hole provided in a top portion of the breech closure 42 to secure the breech closure to the slide 22 and enclose the firing pin bore 26 at the breech end of the slide.

Figure 4:
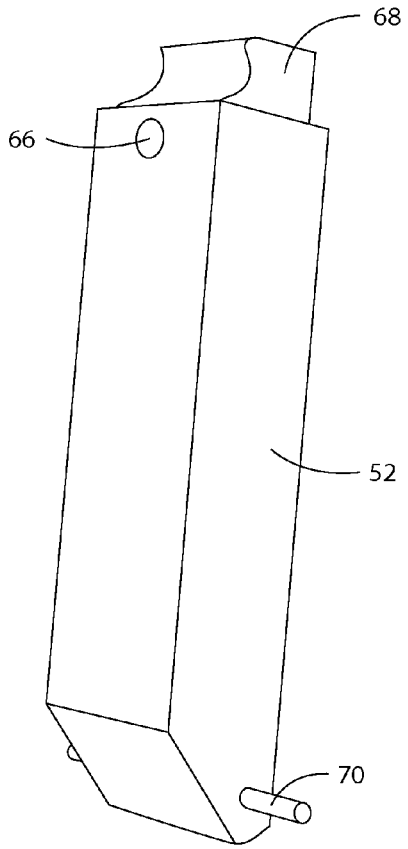
FIG. 4 shows a sear of the sear assembly.
Figure 5:
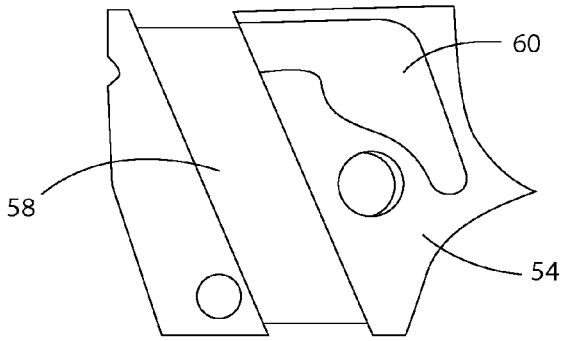
FIG. 5 shows a sear housing of the sear assembly.
Figure 9:
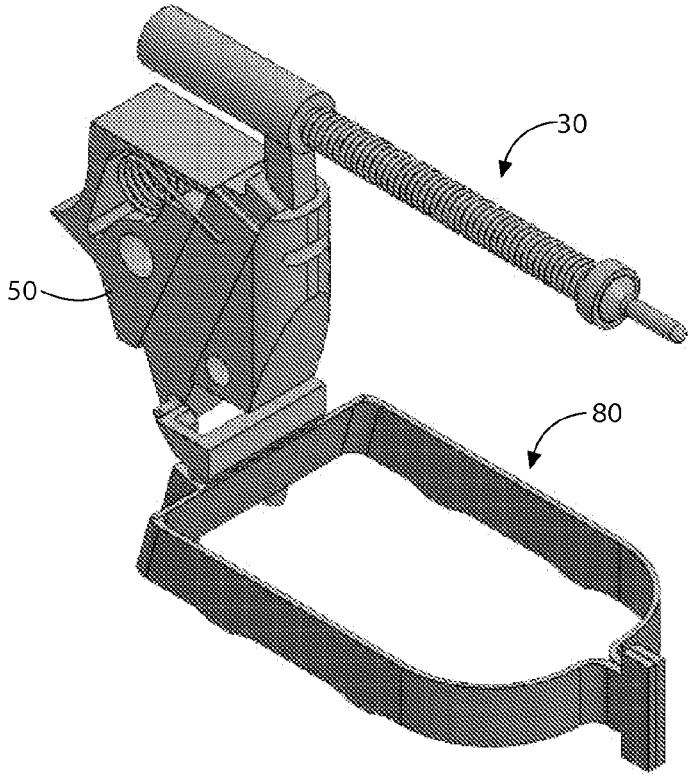
FIG. 9 shows a perspective view of the trigger bow assembly, sear assembly and firing pin assembly with the slide and receiver removed for ease of illustration.
Figure 10:
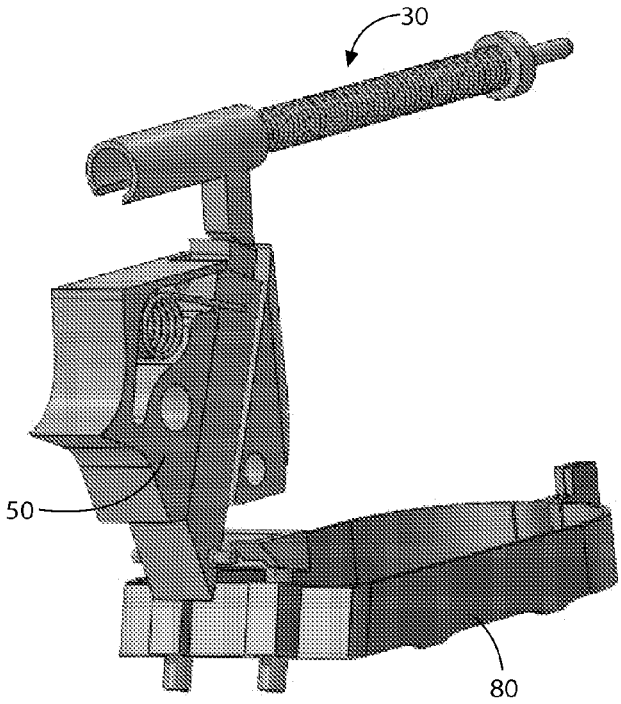
FIG. 10 shows an alternative perspective view of the trigger bow assembly, sear assembly and firing pin assembly with the slide and receiver removed for ease of illustration.
Figure 11:
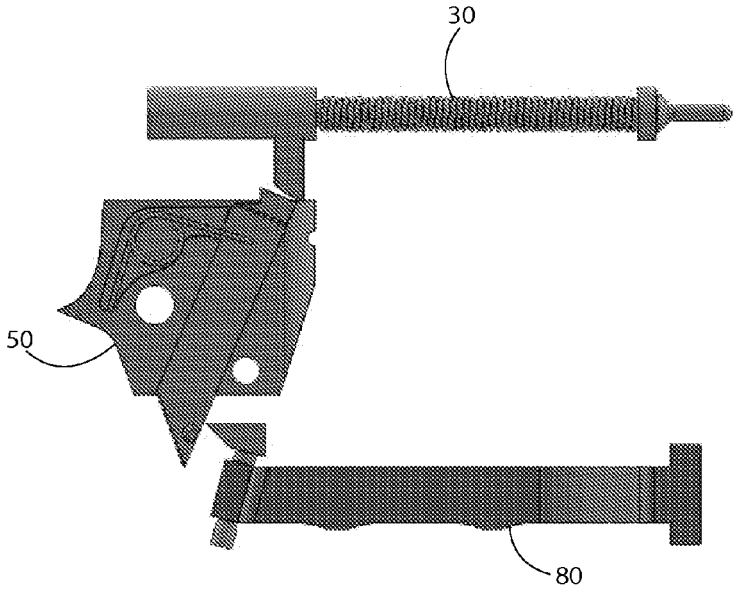
FIG. 11 shows an alternative perspective view of the trigger bow assembly, sear assembly and firing pin assembly with the slide and receiver removed for ease of illustration.

FIGS. 4 and 5 show components of the sear assembly 50. Additional detail of the sear assembly 50 is shown in FIGS. 9-11. The sear assembly comprises the sear 52, a sear housing 54, and sear spring 56. FIG. 3 shows the sear spring 56, FIG. 4 shows the sear 52, and FIG. 5 shows the sear housing 54. Toward the rear, top end of the receiver 24, the sear assembly 50 is installed. The sear housing 54 is shaped to fit in the cavity ordinarily occupied by the hammer mechanism found in a model 1911 handgun. FIG. 9 shows the relative position. For instance, with the slide and grip disassembled from the receiver, the cavity at the rear top end of the receiver may be accessed and the sear housing may be installed into the cavity. The sear housing 54 comprises a generally square piece having a central channel 58 extending generally vertically and at a slight angle (as shown in FIGS. 1 and 2) from the top to the bottom of the sear housing. The sear 52 is disposed in the central channel 58 and the central channel is adapted for easy installation and removal of the sear into and out of the channel. Accordingly, the central channel may have a rectangular (or square) cross section. The sear housing 54 also has a recess 60 formed for holding the sear spring 56. The sear spring 56 may comprise a torsion spring with first and second ends 62,64. The first end 62 may be disposed in a lobe of the sear spring recess 60 and the second end 64 may extend through a hole 66 formed in an upper end of the sear 52. The sear spring 56 urges the sear 52 upward (FIGS. 1 and 2) into engagement with the firing pin lug 40.

The sear 52 may comprise a generally elongated rectangular member with a rectangular (or square) cross section. The sear tab 68 is an upper end of the sear (FIGS. 1 and 2), and a sear pin 70 is provided at an opposite lower end. The sear 52 is sized to removable fit in the sear housing central channel 58. The sear 52 has generally upward and downward and slightly angled (FIGS. 1, 2) reciprocating motion in the sear housing central channel. The upward motion of the sear 52 allows the sear tab 68 to extend into the hollow interior of the slide to engage the firing pin lug 40. When the sear 52 is moved downward, the sear tab 68 disengages the firing pin lug 40 and moves downward out of the hollow interior of the slide and into the central channel of the sear housing.

Figure 8:
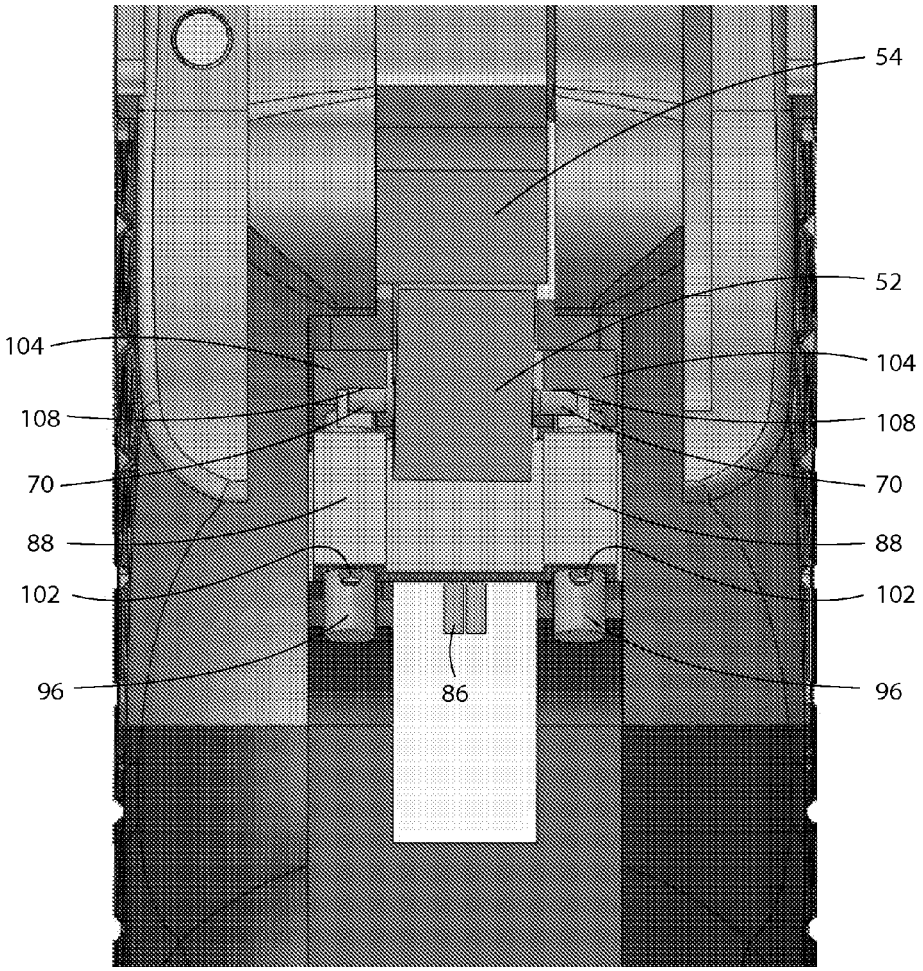
FIG. 8 shows a rear view of the trigger bow lever of FIG. 6 and the bottom portion of the sear of FIG. 4.

As shown in FIGS. 4 and 8, at the lower end of the sear 50, the sear pin 70 is provided. The sear pin 70 may comprise a pin inserted in a hole through the lower end of the sear and fixed in position with opposite ends of the pin projecting from opposing sides of the sear. Alternatively, the sear pin may comprise cylindrical, pin-like surfaces that may be formed or machined in the bottom of sear on opposite sides of the sear. The sear pin is preferably 0.042" in diameter. As explained below in greater detail, the sear pin operatively engages the trigger bow assembly to enable discharging of the weapon and resetting the firing pin thereafter.

Figure 6:
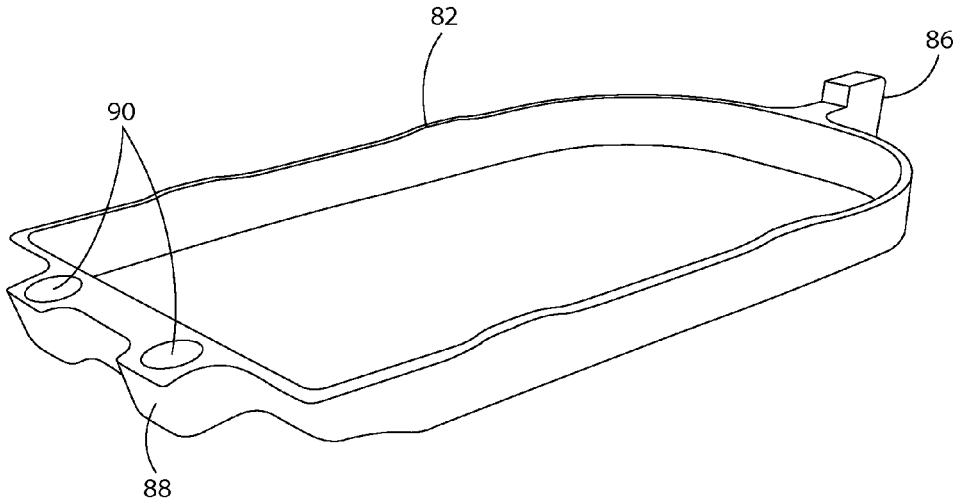
FIG. 6 shows a trigger bow of the trigger bow assembly.

FIGS. 6-11 show the trigger bow assembly 80 and components. The trigger bow assembly comprises a trigger bow 82 and trigger bow lever 84. FIG. 6 shows a perspective view of the trigger bow 82, and FIGS. 7*a*-7*c* show the trigger bow lever 84. Additional detail of the trigger bow assembly 80 is shown in FIGS. 10-12. At the right longitudinal end of the trigger bow 82 (as shown in FIG. 6), the trigger bow has a trigger mount 86 upon which the trigger for the firearm is mounted. At the left longitudinal end of the trigger bow 82 (as shown in FIG. 6) a mount 88 for the trigger bow lever 84 is provided. The trigger bow lever mount 88 comprises two bosses with holes 90 extending therethrough. The mount 88 is preferably aligned and centered relative to the trigger bow width. The mount 88 provides mounting for the trigger bow lever, thereby positioning the trigger bow lever 84 centered around the sear 52. In FIG. 6, the bottom of the trigger bow is shown facing upward and the top of the trigger bow is shown facing downward (relative to FIG. 1).

Figure 7A:
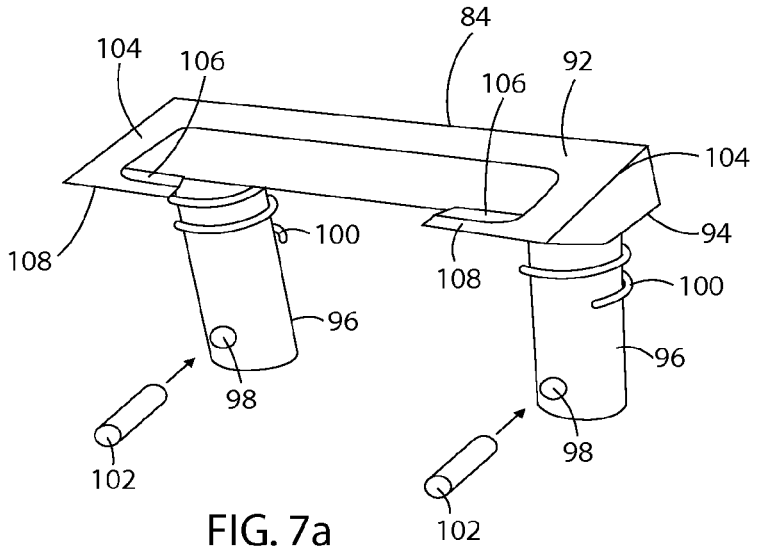
FIGS. 7*a*-7*c* show views of a trigger bow lever of the trigger bow assembly.
Figure 7B:
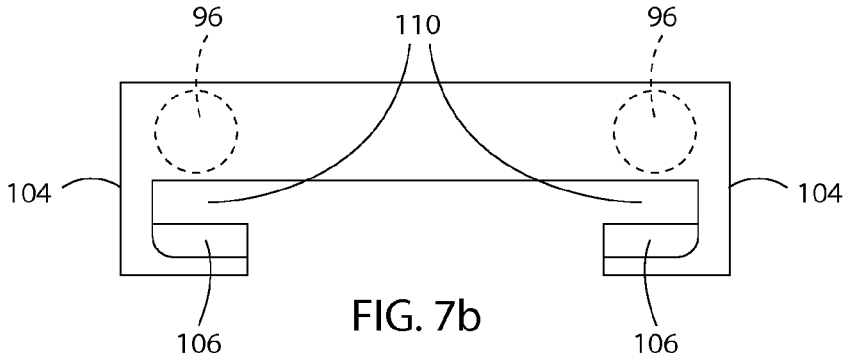
Figure 7C:
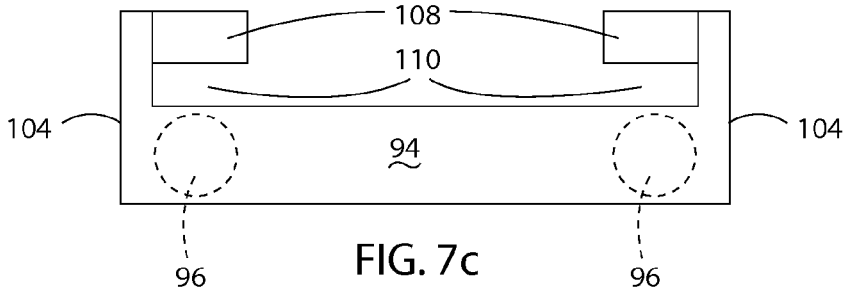

FIGS. 7*a*-7*c* shows the trigger bow lever 84. The trigger bow lever 84 comprises a bifurcated or forked member with a top surface 92 and a bottom surface 94 (relative to FIG. 7). The bottom surface has posts 96. The posts 96 extend through the holes 90 in the bosses of the trigger bow mount 88 when the trigger bow lever is assembled with the trigger bow. The posts 96 have a distal end with a pin hole 98 extending therethrough. A proximal end of the posts is connected to the forked member bottom surface. The trigger bow lever 84 has sear reset coil springs 100 around each of the posts. When the trigger bow lever 84 is assembled with the trigger bow, each of the sear reset coil springs 100 is disposed between the trigger bow lever forked member bottom surface 94 and a top surface of the bosses of the trigger bow lever mount 88. The sear reset springs 100 disposed about each post 96 forces the trigger bow lever upward (FIGS. 1 and 2). To retain the trigger bow lever 84 in the trigger bow mount 88, a securing pin 102 is installed in the pin holes 98 of the distal end of the trigger bow mounting posts 96.

The forked member of the trigger bow lever comprises outer guides 104. As shown in FIG. 8, the outer guides 104 constrain and center the sear 52 and the sear pin 70 between the outer guides relative to the trigger bow assembly during movement of the sear. Each outer guide has a generally upward facing (FIG. 7*b*) and inwardly projecting, sear pin cam release surface 106, and an opposite, generally downward facing (FIG. 7*c*) and inwardly projecting, sear pin cam drive surface 108. The camming surfaces 106,108 engage the sear pin 70 to effect motion of the sear 52 upward and downward in the central channel of the sear housing. The trigger bow lever 84 also includes a sear pin relief 110. The sear pin relief 110 is formed in the center of the trigger bow lever thereby providing the trigger bow lever with a generally U-shaped or bifurcated appearance. The sear pin relief 110 allows the sear pin 70 to move from the sear pin cam drive surface 108 to the sear pin cam release surface 106 during resetting (i.e., upward motion) of the sear 52.

In operation, the trigger bow is held in the receiver such that its motion is limited to horizontal reciprocating motion, as shown in FIGS. 1 and 2. As the trigger is depressed, the trigger bow 82 is moved rearward, and the trigger bow lever sear pin cam drive surface 108 engages the sear pin 70. Continued rearward motion of the trigger bow 82 forces the sear pin cam drive surface 108 to engage the sear pin 70 and drive the sear pin 70 downward against and along the sear pin cam drive surface. During this phase, the trigger bow lever 84 travels to its upward-most position relative to the trigger bow lever mount 88 as the sear reset spring 100 urges the trigger bow lever upward. However, the trigger bow lever 84 is held in the upward-most position by the pins 102 provided in the trigger bow lever mounting post pin holes 98. At the maximum rearward stroke of the trigger bow 82 in the receiver, the sear pin 70 transitions from the sear pin cam drive surface 108 to the sear pin relief 110. The maximum rearward stroke of the trigger bow 82 corresponds to the downward-most travel of the sear 52. The downward-most travel of the sear 52 corresponds with releasing of the sear tab 68 from the firing pin lug 40 and discharge of the hand gun as shown in FIG. 2.

When the sear pin 70 enters the sear pin relief 110 between the driving surfaces 106,108 of the trigger bow lever 84, the trigger bow 82 begins to reposition by moving from the rearward position to the forward position through pressure exerted against the trigger bow by a trigger spring (not shown). As the trigger bow 82 is moved forward (thereby resetting the trigger), the sear pin 70 transitions from the sear pin relief 110 and engages the sear pin cam release surface 106. As the sear pin 70 engages the sear pin cam release surface 106, the trigger bow lever 84 is driven downward in the trigger bow mount 88 against pressure from the sear reset spring 100. Once the sear pin 70 clears the sear pin cam release surface 106 at the forward-most travel of the trigger bow 82, the sear 52 disengages from the trigger bow lever 84. The trigger bow lever 84 then springs upward under the pressure of the sear reset spring 100 to reset the position of the trigger bow lever 84 above the sear pin 70. In this position, the sear pin 70 is below the trigger bow lever 84, and positioned to engage the sear pin cam drive surface 108 once the trigger bow is moved subsequently rearward, for instance, upon depressing the trigger incident to discharge of a subsequent round. FIG. 2 shows the sear and trigger bow lever in such a configuration. Recoil of the slide after discharge of the hand gun enables the sear to be repositioned to hold the firing pin lug in position for discharge of a subsequent round. Preferably, the motion of the sear in the sear housing affected by the trigger bow lever is approximately 3/64 inches to 1/32 inches.

The system and methods described above allows for elimination of the hammer firing mechanism ordinarily associated with a model 1911 handgun. In accordance with the description herein, the trigger pull ordinarily associated with a model 1911 handgun (typically, the trigger pull pressure is between 5 and 6 pounds) is preserved. Additionally, the trigger pull distance ordinarily characteristic of a model 1911 handgun (typically less than 1/4 inches) is preserved. As described above, the hammer system associated with a conventional model 1911 handgun may be removed and with slight modifications to the slide and installation of the sear assembly, firing pin assembly and trigger bow assembly, a hammerless, striker fired model 1911 handgun may be provided.

While specific embodiments have been described in detail in the foregoing detailed description and illustrated in the accompanying drawings, those with ordinary skill in the art will appreciate that various modifications and alternatives to those details could be developed in light of the overall teachings of the disclosure. Accordingly, the particular arrangements disclosed were meant to be illustrative only and not limited as to the scope of the invention which is to be given the full breadth of the appended claims and any and all equivalents thereof.

What is claimed is:

1. A single action, semi-automatic handgun comprising: a slide slidably coupled to a frame of the handgun and movable relative to the frame between an in-battery position and an out-of-battery position; a firing pin assembly disposed in a hollow interior of the slide generally at a breech end of the slide;

a trigger bow assembly disposed in the frame of the handgun below the slide, the trigger bow assembly comprising a trigger bow configured for reciprocating sliding motion in a plane generally parallel to the movement of the slide, the trigger bow having first and second longitudinal ends, the trigger bow first longitudinal end being operatively connected to a trigger of the handgun and the trigger bow second longitudinal end having a mount configured to receive a trigger bow lever, the trigger bow lever being movable in the trigger bow mount relative to the trigger bow between a sear pin pre-engagement position and a sear pin pre-release position, the trigger bow lever being urged to the sear pin pre-engagement position with a sear reset spring;

a sear assembly disposed in the frame of the handgun below the slide, the sear assembly comprising a sear, the sear having a tab at a first end and a sear pin at an opposite second end, the sear being movable between a cocked position in which the sear tab engages the firing pin assembly and discharge position in which the sear tab disengages the firing pin assembly, the sear being urged to the cocked position with a sear spring, wherein the sear is in the cocked position when the trigger bow lever is in the sear pin pre-engagement position and the sear is in the discharge position when the trigger bow lever approaches the sear pin pre-release position; and wherein the trigger bow lever engages the sear pin in a manner to move the sear from the cocked position to the discharge position as the trigger bow lever moves from the sear pin pre-engagement position to the sear pin pre-release position.

2. The handgun of claim 1, wherein the trigger bow lever releases from the sear pin in a manner that enables the sear to move from the discharge position to the cocked position as the trigger bow lever moves from the sear pin pre-release position to the sear pin pre-engagement position.

3. The handgun of claim 1, wherein the trigger bow lever comprises a first cam surface that engages the sear pin in a manner to move the sear from the cocked position to the discharge position.

4. The handgun of claim 3, wherein the trigger bow lever comprises a second cam surface that engages the sear pin as the trigger bow repositions after a round is discharged.

5. The handgun of claim 4, wherein the second cam surface engages the sear pin with the sear in the cocked position.

6. The handgun of claim 5, wherein the trigger bow lever is a bifurcated member with spaced apart guides.

7. The handgun of claim 6, wherein each of the trigger bow lever guides has a first and second cam surfaces.

8. The handgun of claim 7, wherein the sear is disposed between the guides when the sear moves between the cocked position and the discharge position.

9. The handgun of claim 1, wherein the trigger bow lever is positioned in the sear pin pre-engagement position via the sear reset spring and a mechanical stop opposing a bias associated with the sear reset spring.

10. The handgun of claim 1, wherein the handgun is a model 1911 handgun.

11. The handgun of claim 1, wherein the firing pin assembly comprises a preloaded firing pin.

12. The handgun of claim 1, wherein a round is chambered by racking the slide of the handgun.

13. A single action, semi-automatic handgun comprising: a slide slidably coupled to a frame of the handgun and movable relative to the frame between an in-battery position and an out-of-battery position;

a firing pin assembly disposed in a hollow interior of the slide generally at a breech end of the slide;

a trigger bow assembly disposed in the frame of the handgun below the slide, the trigger bow assembly comprising a trigger bow configured for reciprocating sliding motion in a plane generally parallel to the movement of the slide, the trigger bow having first and second longitudinal ends, the trigger bow first longitudinal end being operatively connected to a trigger of the handgun and the trigger bow second longitudinal end having a trigger bow lever, the trigger bow lever being configured for reciprocating sliding motion in plane generally transverse to the movement of the slide; and a sear assembly disposed in the frame of the handgun below the slide, the sear assembly comprising a sear having a tab at a first end and a sear pin at an opposite second end, the sear being configured for reciprocating sliding motion in a plane generally transverse to the movement of the slide and parallel to the reciprocating motion of the trigger bow lever, the sear tab releasably engaging the firing pin assembly and the sear pin releasably engaging the trigger bow lever in a manner to enable successive discharging of the handgun upon successive actuation of the trigger of the firearm.

14. The handgun of claim 13, wherein the sear is urged to engage the firing pin assembly with a sear spring.

15. The handgun of claim 13, wherein the trigger bow lever comprises a first cam surface that engages the sear pin in a manner to disengage the sear from the firing pin assembly.

16. The handgun of claim 15, wherein the trigger bow lever comprises a second cam surface that engages the sear pin as the trigger bow repositions after a round has been discharged.

17. The handgun of claim 16, wherein the trigger bow lever has spaced apart guides with a central opening.

18. The handgun of claim 17, wherein the sear is disposed between the guides when the sear pin is engaged with the trigger bow lever.

19. The handgun of claim 16, wherein each of the trigger bow lever guides has the first and second cam surfaces.

20. The handgun of claim 13, wherein the trigger bow lever is biased with a sear pin reset spring.

21. The handgun of claim 20, wherein the sear pin reset spring and a mechanical stop opposing a bias associated with the sear reset spring position the trigger bow lever relative to the sear pin to enable the trigger bow lever to engage the sear pin prior to discharge of a round.

22. The handgun of claim 13, wherein the handgun is a model 1911 handgun.

23. The handgun of claim 13, wherein the firing pin assembly comprises a preloaded firing pin.

24. The handgun of claim 23, wherein a round is chambered by racking the slide of the handgun.

25. A kit configured to replace a hammer assembly of a single action, semi-automatic handgun comprising:

a trigger bow assembly configured to be disposed in a frame of the handgun below a slide of the handgun, the trigger bow assembly comprising a trigger bow configured for reciprocating sliding motion in a plane generally parallel to the movement of the slide of the handgun, the trigger bow having first and second longitudinal ends, the trigger bow first longitudinal end being operatively connected to a trigger of the handgun and the trigger bow second longitudinal end having a trigger bow lever, the trigger bow lever being configured for reciprocating sliding motion in plane generally transverse to the movement of the slide of the handgun; and a sear assembly configured to be disposed in a cavity in the frame of a handgun ordinarily occupied by the hammer assembly, the sear assembly comprising a housing dimensioned to substantially occupy the cavity, the housing having a central opening configured to receive a sear therein, the sear being configured for reciprocating sliding motion in the central opening in a plane generally transverse to the movement of the slide of the handgun and parallel to the reciprocating motion of the trigger bow lever, the sear having a tab at a first end and a sear pin at an opposite second end, the sear tab configured to releasably engage a firing pin assembly of the handgun and the sear pin configured to releasably engage the trigger bow lever in a manner to enable successive discharging of the handgun upon successive actuation of the trigger of the firearm.

26. The kit of claim 25, wherein the sear is urged to be engagable with the firing pin assembly with a sear spring.

27. The kit of claim 25, wherein the trigger bow lever comprises a first cam surface that engages the sear pin in a manner to such that the sear is disengageable from the firing pin assembly.

28. The kit of claim 27, wherein the trigger bow lever comprises a second cam surface that is engageable with the sear pin as the trigger bow repositions after a round has been discharged.

29. The kit of claim 28, wherein the trigger bow lever has spaced apart guides with a central opening.

30. The kit of claim 29, wherein the sear is disposed between the guides when the sear pin is engaged with the trigger bow lever.

31. The kit of claim 29, wherein each of the trigger bow lever guides has the first and second cam surfaces.

32. The kit of claim 25, wherein the trigger bow lever is biased with a sear pin reset spring.

33. The kit of claim 32, wherein the sear pin reset spring and a mechanical stop opposing a bias associated with the sear reset spring position the trigger bow lever relative to the sear pin to enable the trigger bow lever to engage the sear pin prior to discharge of a round.

34. The kit of claim 25, wherein the kit is adapted to be installed in a model 1911 handgun.

* * * * *